US006053754A

United States Patent [19]

Kano et al.

[11] Patent Number: 6,053,754

[45] Date of Patent: Apr. 25, 2000

[54] WATERPROOF CONNECTOR

[75] Inventors: Koji Kano; Koji Suzuki; Yuji Ono; Naoki Murasawa, all of Saitama, Japan

[73] Assignee: Honda Giken Kogyo Kabushiki Kaisha, Tokyo, Japan

[21] Appl. No.: 09/199,434

[22] Filed: Nov. 25, 1998

[30] Foreign Application Priority Data

Nov. 26, 1997 [JP] Japan ..... 9-324536

[51] Int. Cl.[7] ..... H01R 13/52

[52] U.S. Cl. ..... 439/281

[58] Field of Search ..... 439/271, 272, 439/273, 274, 275, 281, 587, 589, 278

[56] References Cited

U.S. PATENT DOCUMENTS

| | | | |
|---|---|---|---|
| 3,678,441 | 7/1972 | Upstone et al. | 439/272 |
| 4,768,970 | 9/1988 | Nestor | 439/281 |
| 5,580,266 | 12/1996 | Shelly | 439/281 |
| 5,735,702 | 4/1998 | Hio | 439/271 |

FOREIGN PATENT DOCUMENTS

| | | |
|---|---|---|
| 61-179077 | 8/1986 | Japan . |
| 2018279 | 2/1990 | Japan . |

*Primary Examiner*—Paula Bradley
*Assistant Examiner*—Tho D. Ta
*Attorney, Agent, or Firm*—Birch, Stewart, Kolasch & Birch, LLP

[57] ABSTRACT

To provide a waterproof connector capable of reducing a load applied upon connection or separation of a male connector to or from a female connector while sufficiently ensuring sufficient waterproofing. A plurality of individually fitting projections, each being adapted to support a female terminal, are provided on the top surface of a collectively fitting projection provided in a female connector housing. In a male connector housing, a plurality of individually fitting recesses, in each of which an associated one of the individually fitting projections is fittable, are provided in a bottom surface portion of a collectively fitting recess in which the collectively fitting projection is fittable. Each of the individually fitting recesses is adapted to support a male terminal. An elastic sealing member supported by the female connector housing includes a pair of collectively sealing lips respectively formed on the inner and outer peripheral surfaces of a collectively sealing portion to be held between the collectively fitting projection and the collectively fitting recess, and a pair of individually sealing lips respectively formed on the inner and outer peripheral surfaces of each of the individually sealing portions to be held between the associated one of the individually fitting portions and the associated one of the individually fitting recesses.

12 Claims, 11 Drawing Sheets

WATERPROOF CONNECTOR

BACKGROUND OF THE INVENTION

1. Field of the Invention

The present invention relates to a waterproof connector for making waterproof mutual contact regions of each of female terminals and the associated one of male terminals by interposing an elastic sealing member between a female connector housing and a male connector housing.

2. Description of Related Art

Waterproof connectors are known, for example, in Japanese Patent Laid-open Nos. Sho 61-179077 and Hei 2-18279.

The waterproof connector described in the above document, Japanese Patent Laid-open No. Sho 61-179077 is intended to obtain a so-called group-waterproof structure by surrounding the outer peripheral side of a plurality of terminals with seal lips of a sealing member. Accordingly, such a waterproof connector may cause problems if water permeates the sealing member, since all of the terminals are made conductive with each other, short circuit and electrolytic corrosion may result. The waterproof connector described in the above document, Japanese Patent Laid-open No. Hei 2-18279 is intended to obtain a so-called single electrode waterproof structure by individually sealing the outer peripheries of electrodes with seal lips. Accordingly, it is superior to the above waterproof connector having the group-waterproof structure in terms of its waterproof characteristic. However, this single electrode waterproof structure is problematic, since a plurality of the seal lips are in contact with each connector housing. Therefore, the total length of mutual contact regions of the seal lips and the connector housing becomes longer as compared with the group waterproof structure, so that the friction resistance between the seal lips and the connector housing is increased. As a result, in the single electrode waterproof type connector, it is required to apply a large load for connecting or separating a male connector to or from a female connector, reducing the operability of the waterproof connector. In particular, if a plurality of rows of seal lips are provided for each electrode for enhancing the waterproof characteristic, the above load must be further increased.

SUMMARY OF THE INVENTION

In view of the foregoing, the present invention has been made, and an object of the present invention is to provide a waterproof connector capable of reducing a load applied for connecting or separating a female connector to or from a male connector while sufficiently ensuring the waterproof characteristic.

To achieve the above object, according to the present invention, there is provided a waterproof connector comprising: a female connector including a female connector housing and a plurality of female terminals supported by the female connector housing; a male connector including a male connector housing and a plurality of male terminals supported by the male connector housing; and an elastic sealing member interposed between the female connector housing and the male connector housing when the male connector is connected to the female connector, to seal mutual contact regions of each of the female terminals and the associated one of the male terminals. The above female connector further includes: a collectively fitting projection projecting from the female connector housing toward the male connector; and a plurality of individually fitting projections provided on the top surface of the collectively fitting projection in such a manner that each of the projections supports the associated one of the female terminals. The above male connector further includes: a collectively fitting recess into which the collectively fitting projection of the female connector housing is fittable; and a plurality of individually fitting recesses into each of which the associated one of the individually fitting projections of the female connector housing is fittable, the recesses being recessed in a bottom surface portion of the collectively fitting recess in such a manner that each of the recesses supports the associated one of the male terminals. The above elastic sealing member further includes: a collectively sealing portion held between the collectively fitting projection of the female connector housing and the collectively fitting recess of the male connector housing when the male connector is connected to the female connector; and a plurality of individually sealing portions provided integrally with the collectively sealing portion, each of the individually sealing portions being held between the associated one of the plurality of individually fitting projections of the female connector housing and the associated one of the plurality of individually fitting recesses of the male connector housing when the male connector is connected to the female connector; wherein a pair of collectively sealing lips, allowed to be brought in contact with the collectively fitting projection and the collectively fitting recess respectively, are formed on the inner and outer peripheral surfaces of the collectively sealing portion at positions identical to each other in the longitudinal direction, respectively; and a pair of individually sealing lips, allowed to be brought in contact with the associated one of the individually fitting projections and the associated one of the individually fitting recesses respectively, are formed on the inner and outer peripheral surfaces of each of the individually sealing portions at positions identical to each other in the longitudinal direction, respectively.

With the configuration of the present invention described above, when the male connector is connected to the female connector, the space between the collectively fitting projection of the female connector housing and the collectively fitting recess of the male connector housing is sealed by the pair of collecting sealing lips provided on the collectively sealing portion of the sealing member. Furthermore, the space between each of the individually fitting projections of the female connector housing and the associated one of the individually fitting recesses of the male connector housing is sealed by the pair of the individually sealing lips provided on the associated one of the individually sealing portions of the sealing member. Accordingly, the mutual contact regions of each of the female terminals and the associated one of the male terminals are sealed in double-stages, resulting in the enhanced waterproof characteristic. Also, with the configuration of the present invention described above, the pair of the individually sealing lips are respectively formed on the inner and outer surfaces of the collectively sealing portion of the sealing member at positions identical to each other in the longitudinal direction. Furthermore, the pair of collectively sealing lips are respectively formed on the inner and outer surfaces of each of the individually sealing portions at positions identical to each other in the longitudinal direction. As a result, it is possible to suppress a frictional force produced between the seal lips and the sealing surfaces at minimum upon connection/separation of the male connector to/from the female connector while ensuring a good waterproof characteristic by ensuring close contact between the seal lips and the sealing surfaces. Therefore, the operation of connecting/separating the male connector to/from the female connector is improved.

According to a second aspect of the present invention, there is provided a waterproof connector comprising: a female connector including a female connector housing and a plurality of female terminals supported by the female connector housing; a male connector including a male connector housing and a plurality of male terminals supported by the male connector housing; and an elastic sealing member supported by the female connector housing, the member being interposed between the female connector housing and the male connector housing when the male connector is connected to the female connector, to seal mutual contact regions of each of the female terminals and the associated one of the male terminals. The above female connector further includes: a collectively fitting projection projecting from the female connector housing toward the male connector; and a plurality of individually fitting projections provided on the top surface of the collectively fitting projection in such a manner that each of the projections supports the associated one of the female terminals. The above male connector further includes: a collectively fitting recess into which the collectively fitting projection of the female connector housing is fittable; and a plurality of individually fitting recesses into each of which the associated one of the individually fitting projections of the female connector housing is fittable, the recesses being recessed in a bottom surface portion of the collectively fitting recess in such a manner that each of the recesses supports the associated one of the male terminals. The above elastic sealing member further includes: a collectively sealing portion having a collectively sealing lip, wherein when the male connector is connected to the female connector, the lip is allowed to be brought in contact with the collectively fitting recess in a state in which the portion is held between the collectively fitting projection of the female connector housing and the collectively fitting recess of the male connector housing; and a plurality of individually sealing portions provided integrally with the collectively sealing portion, each of the individually sealing portions having an individually sealing lip, wherein when the male connector is connected to the female connector, each of the lips is allowed to be brought in contact with the associated one of the individually fitting recesses in a state in which each of the portions is held between the associated one of the plurality of individually fitting projections of the female connector housing and the associated one of the plurality of individually fitting recesses of the male connector housing; wherein when the male connector is connected to the female connector, a sliding distance for which the collectively sealing lip is slid in contact with the collectively fitting recess is set to be smaller than a fitting distance for which each of the male terminals is fitted into the associated one of the female terminals; and a sliding distance for which each of the individually sealing lips is slid in contact with the associated one of the individually fitting recesses is also set to be smaller than the fitting distance.

According to a third aspect of the present invention, there is provided a waterproof connector comprising: a female connector including a female connector housing and a plurality of female terminals supported by the female connector housing; a male connector including a male connector housing and a plurality of male terminals supported by the male connector housing; and an elastic sealing member supported by the male connector housing, the member being interposed between the female connector housing and the male connector housing when the male connector is connected to the female connector, to seal mutual contact regions of each of the female terminals and the associated one of the male terminals. The above female connector further includes: a collectively fitting projection projecting from the female connector housing toward the male connector; and a plurality of individually fitting projections provided on the top surface of the collectively fitting projection in such a manner that each of the projections supports the associated one of the female terminals. The above male connector further includes: a collectively fitting recess into which the collectively fitting projection of the female connector housing is fittable; and a plurality of individually fitting recesses into each of which the associated one of the individually fitting projections of the female connector housing is fittable, the recesses being recessed in a bottom surface portion of the collectively fitting recess in such a manner that each of the recesses supports the associated one of the male terminals. The above elastic sealing member further includes: a collectively sealing portion having a collectively sealing lip, wherein when the male connector is connected to the female connector, the lip is allowed to be brought in contact with the collectively fitting projection in a state in which the portion is held between the collectively fitting projection of the female connector housing and the collectively fitting recess of the male connector housing; and a plurality of individually sealing portions provided integrally with the collectively sealing portion, each of the individually sealing portions having an individually sealing lip, wherein when the male connector is connected to the female connector, each of the lips is allowed to be brought in contact with the associated one of the individually fitting projections in a state in which each of the portions is held between the associated one of the plurality of individually fitting projections of the female connector housing and the associated one of the plurality of individually fitting recesses of the male connector housing; wherein when the male connector is connected to the female connector, a sliding distance for which the collectively sealing lip is slid in contact with the collectively fitting projection is set to be smaller than a fitting distance for which each of the male terminals is fitted into the associated one of the female terminals; and a sliding distance for which each of the individually sealing lips is slid in contact with the associated one of the individually fitting projections is also set to be smaller than the fitting distance.

With the configuration of the present invention described above with regard to the second and third aspects of the present invention, when the male connector is connected to the female connector, the space between the collectively fitting projection of the female connector housing and the collectively fitting recess of the male connector housing by the pair of collectively sealing lips provided on the collectively sealing portion of the sealing member is sealed. Furthermore, the space between each of the individually fitting projections of the female connector housing and the associated one of the individually fitting recesses of the male connector housing is sealed by the pair of individually sealing lips provided on the associated one of the individually sealing portions of the sealing member. Accordingly, the mutual contact regions of each of the female terminals and the associated one of the male terminals is sealed in double-stages, resulting in the enhanced waterproof characteristic. Also, since each of the sliding distances for which each of the individually sealing lips and the collectively sealing lip are respectively slid in contact with the associated sealing surfaces is smaller than the fitting distance for which each of the male terminals is fitted in the associated one of the female terminals when the male connector is connected to the female connector, it is possible to reduce a stroke which causes a sliding resistance due to friction of the seal lips. Therefore, the operation of connecting/separating the male connector to/or from the female connector is improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described with reference to the accompanying drawings. FIGS. 1 to 9 show one embodiment of the present invention.

Figure 1:
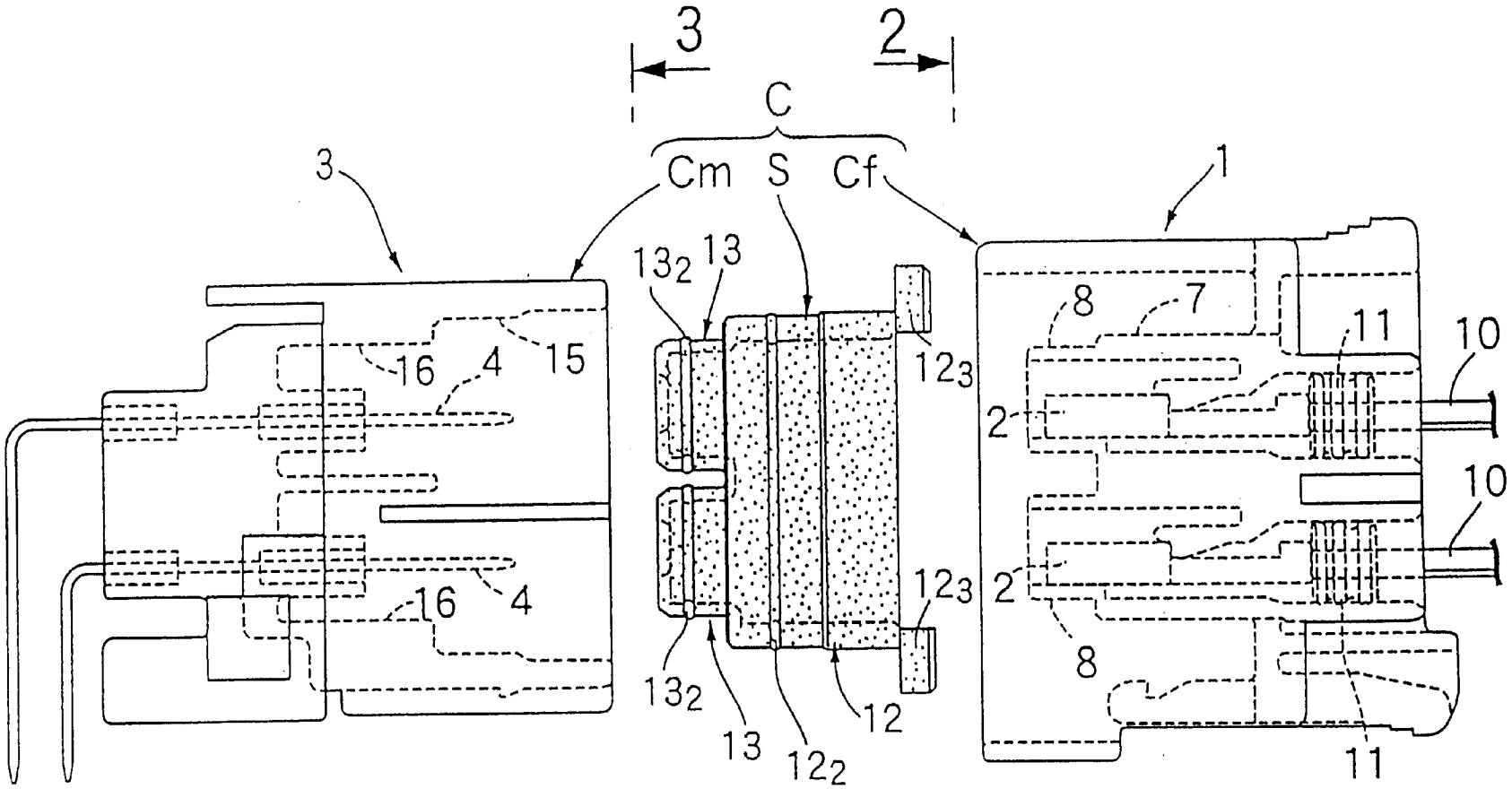
FIG. 1 is an exploded perspective view of a waterproof connector according to the present invention.
Figure 2:
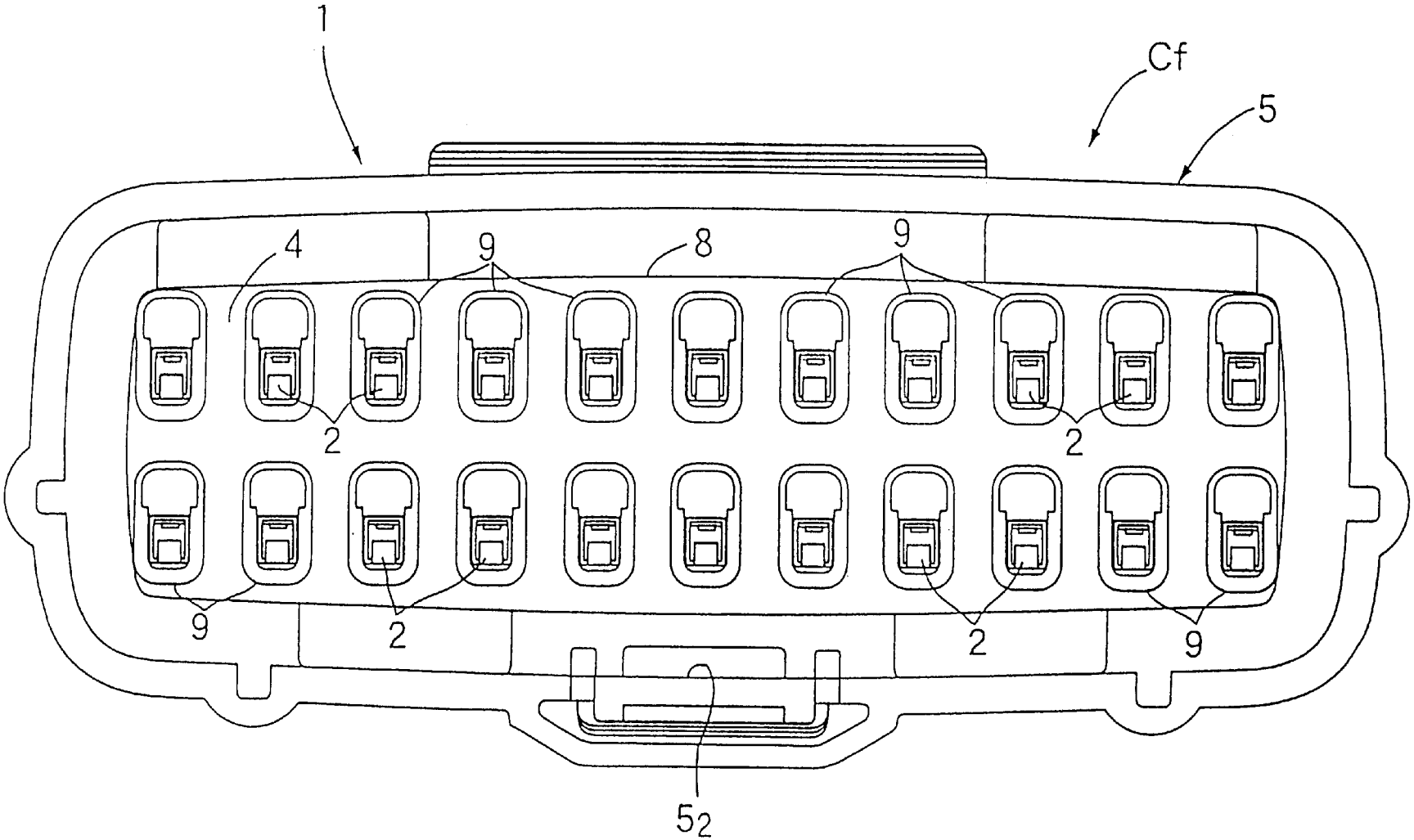
FIG. 2 is a view in the direction of arrows 2 in FIG. 1.

Referring to FIG. 1, a waterproof connector C includes a female connector Cf, a male connector Cm, and a rubber elastic sealing member S. The female connector Cf has a female connector housing 1 integrally molded from a synthetic resin. Twenty-two (22) female terminals 2 are supported by the female connector housing 1. The male connector Cm has a male connector housing 3 integrally molded from a synthetic resin. Twenty-two (22) male terminals 4 are supported by the male connector housing 3. The elastic sealing member S is to be interposed between the female connector Cf and the male connector Cm for making waterproof mutual contact regions of each of the female terminals 2 and an associated one of the male terminals 4.

As is apparent from FIGS. 2 to 6, the female connector housing 1 of the female connector Cf includes a housing main body 5 formed into a short cylindrical shape and having an approximately rectangular cross-section. A collectively fitting projection 7 having an approximately rectangular cross-section is integrally provided on a bottom wall 6 of the housing main body 5 so as to project from the bottom wall 6 toward the opening of the female connector housing 1. Twenty-two (22) individually fitting projections 8, aligned in two rows, are integrally provided projecting from the top surface of the collectively fitting projection 7.

Each of the female terminals 2 is supported in a female terminal containing hole 9 penetrating both the collectively fitting projection 7 and the associated one of the individually fitting projections 8. A lead wire 10 connected to the female terminal 2 passes through a rubber grommet 11 fitted in the open end of the female terminal containing hole 9. The lead wire extends outwardly from the female connector housing 1. With this configuration, each of the female terminals 2 can be prevented from getting wet from water permeating through the open end of the associated one of the female terminal containing holes 9.

Figure 6:
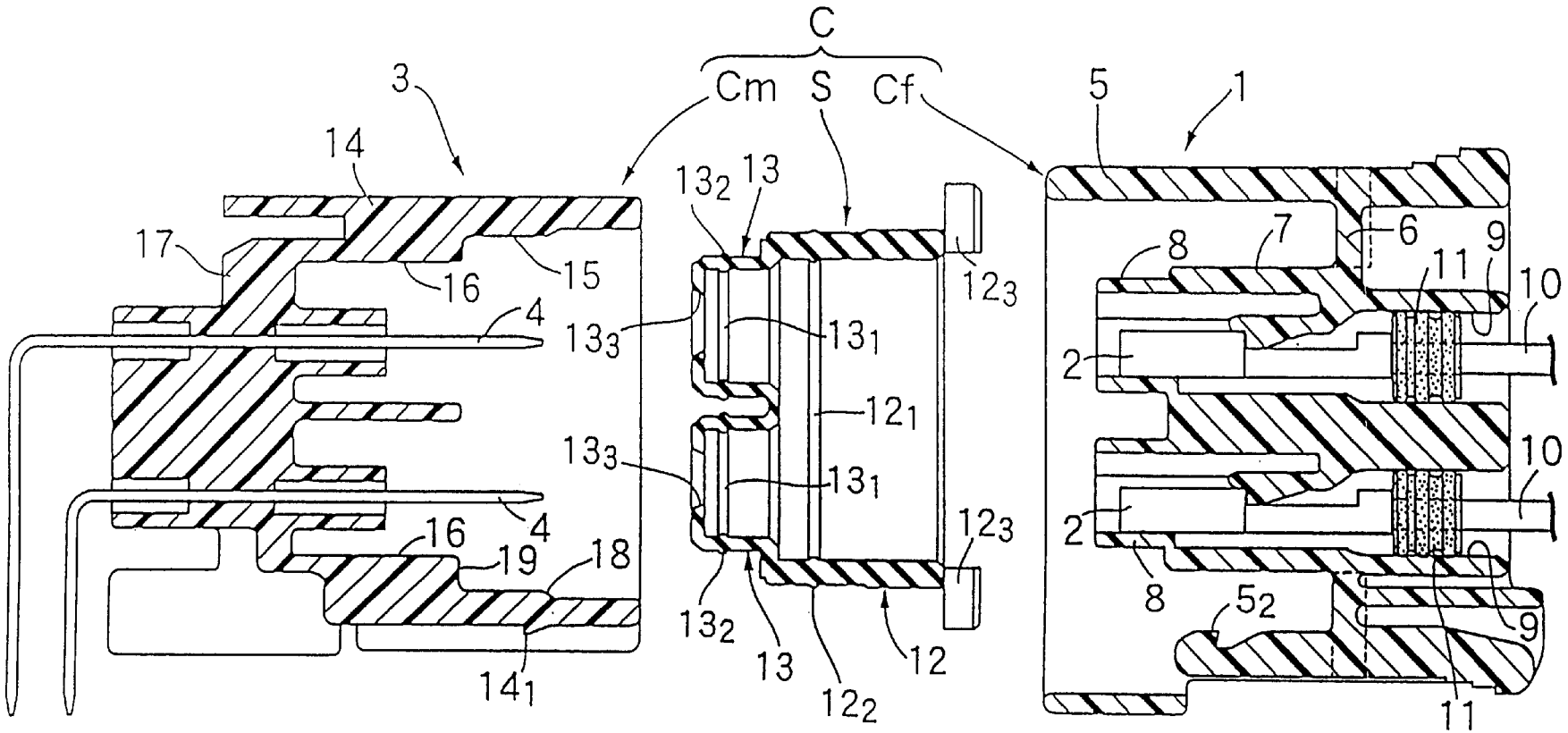
FIG. 6 is a sectional view of the present invention, similar to FIG. 1.
Figure 7:
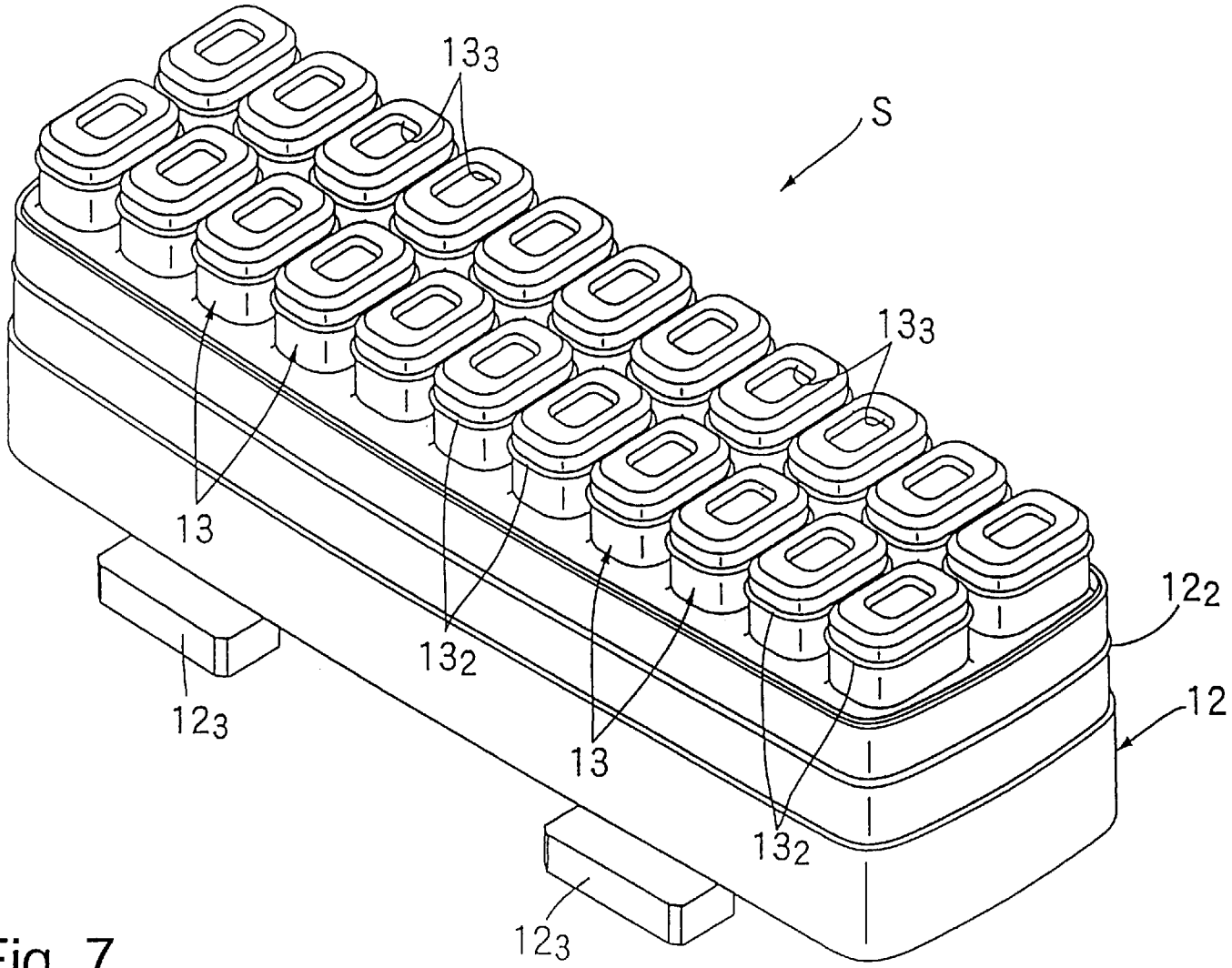
FIG. 7 is a perspective view of the elastic sealing member of the present invention.

Referring to FIGS. 6 and 7, the elastic sealing member S includes a collectively sealing portion 12. Twenty-two (22) individually sealing portions 13 are integral with the collectively sealing portion 12. The collectively sealing portion 12 is to be fitted around the outer periphery of the collectively fitting projection 7 of the female connector housing 1. The individually sealing portions 13, each of which is to be fitted around the outer periphery of the associated one of the individually fitting projections 8 of the female connector housing 1, project from the top surface of the collectively sealing portion 12. Ring-shaped collectively sealing lips $\mathbf{12}_1$ and $\mathbf{12}_2$ are respectively formed on the inner and outer peripheral surfaces of the collectively sealing portion 12 at positions identical to each other in the longitudinal direction. Four locking projections $\mathbf{12}_3$ are provided at edge portions of the collectively sealing portion 12. Also, ring-shaped individually sealing lips $\mathbf{13}_1$ and $\mathbf{13}_2$ are respectively formed on the inner and outer peripheral surfaces of each of the individually sealing portions 13 at positions identical to each other in the longitudinal direction. An opening $\mathbf{13}_3$ is formed in the top surface portion of each f the individually sealing portions 13. When the elastic sealing member S is mounted in the female connector housing 1, the four locking projections $\mathbf{12}_3$ of the elastic sharing member S are engaged in four locking holes 51 formed in the housing main body 5 of the female connector housing 1, so that the elastic sealing member S is prevented from slipping off from the female connector housing 1 (see FIGS. 4 and 5). Also, in such a mounting state, since the female terminals 2 are exposed through the openings $\mathbf{13}_3$ of the individually sealing portions 13 of the elastic sealing member S, the male terminals 4 of the male connector Cm can be inserted in and connected to the female terminals 2 of the female connector Cf via the openings $\mathbf{13}_3$ (see FIG. 8).

Furthermore, when the elastic sealing member S is mounted in the female connector housing 1, the collectively sealing lip $\mathbf{12}_1$ formed on the inner peripheral surface of the collectively sealing portion 12 of the elastic sealing member S is in contact with the outer peripheral surface of the collectively fitting projection 7 of the female connector housing 1. The individually sealing lip $\mathbf{13}_1$ formed on the inner peripheral surface of each of the individually sealing portions 13 of the elastic sealing member S is in contact with the outer peripheral surface of the associated one of the individually fitting projections 8 of the female connector housing 1 (see FIG. 8).

Figure 3:
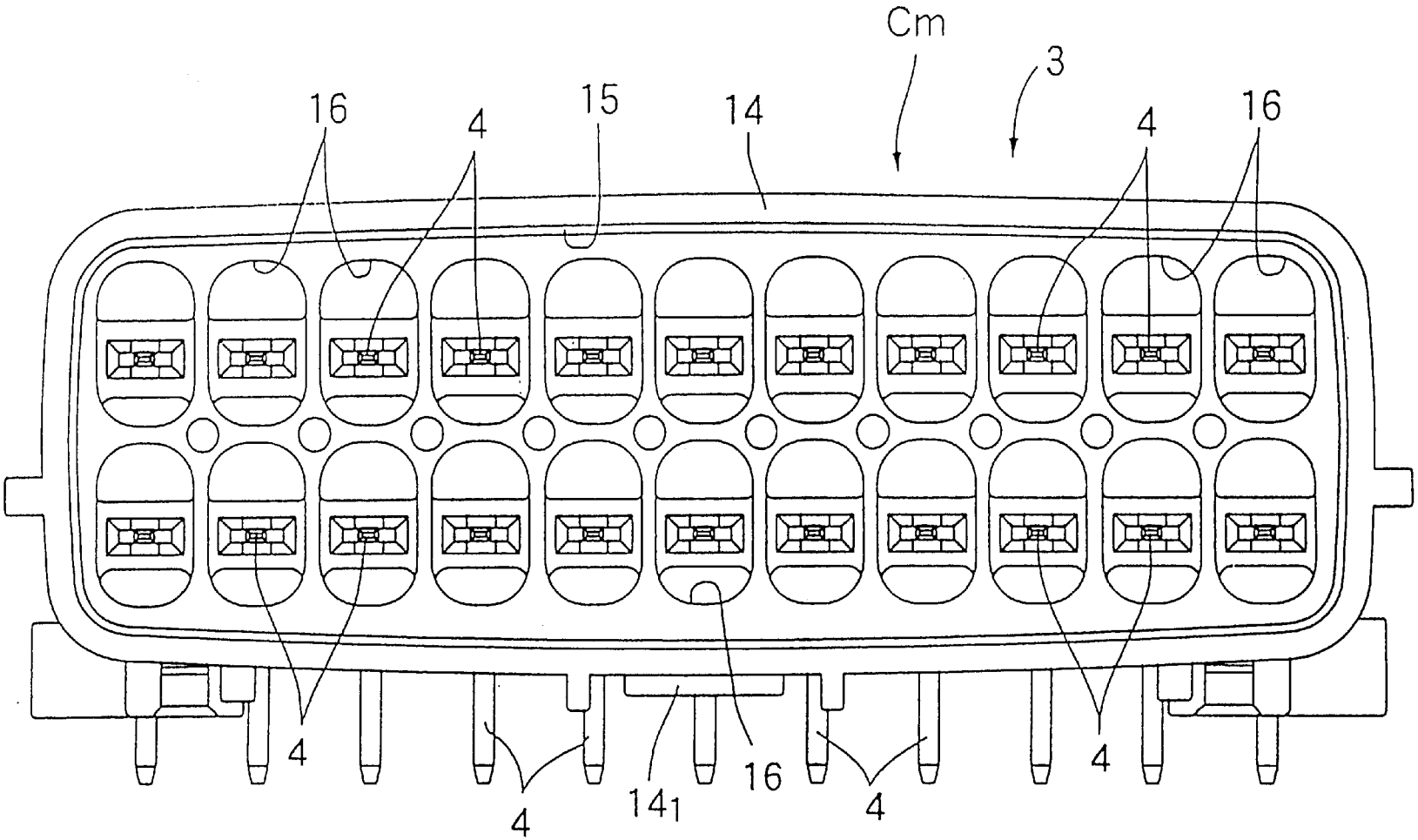
FIG. 3 is a view in the direction of arrows 3 in FIG. 1.
Figure 4:
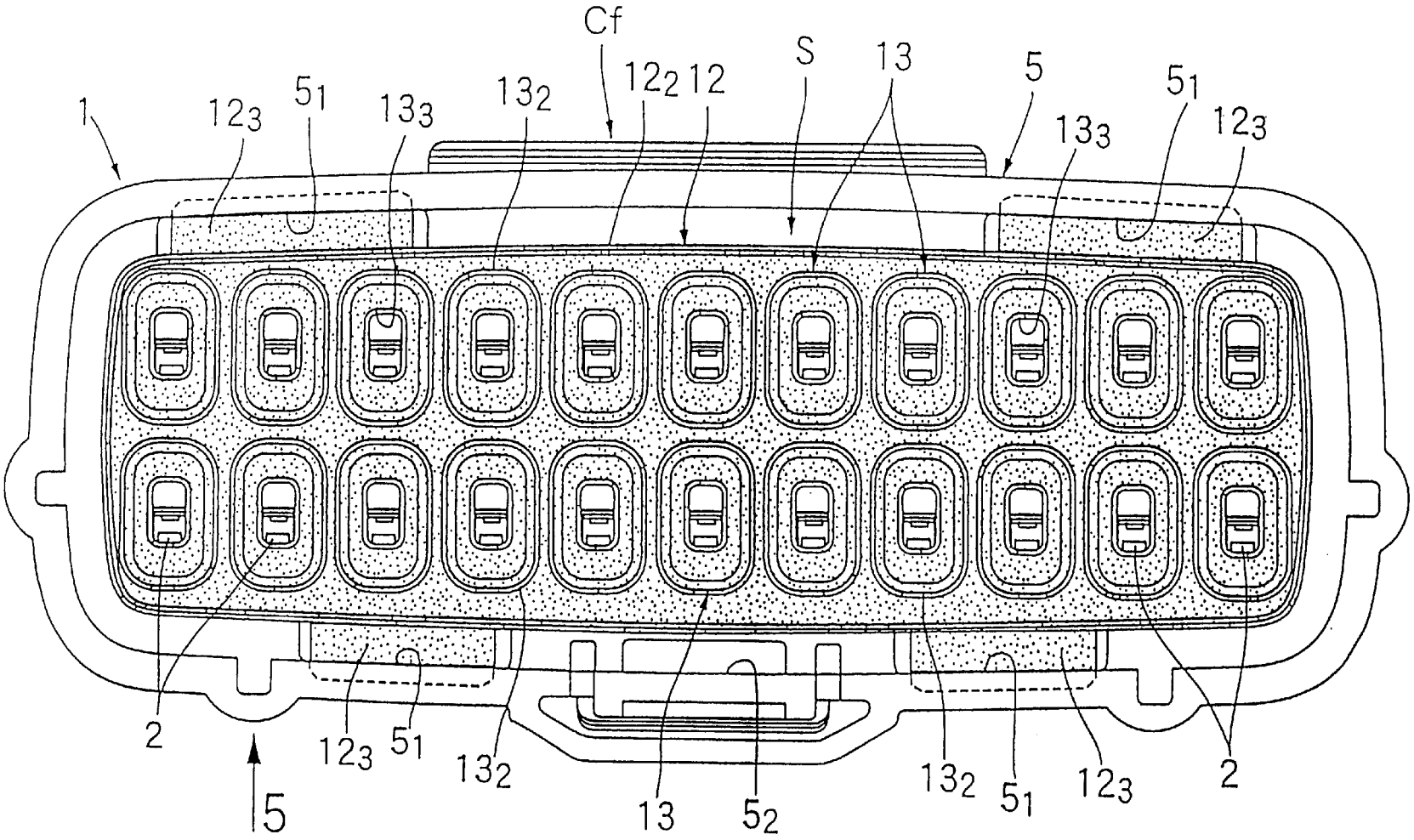
FIG. 4 is a view illustrating a state in which an elastic sealing member is mounted in the female connector housing of FIG. 2.
Figure 5:
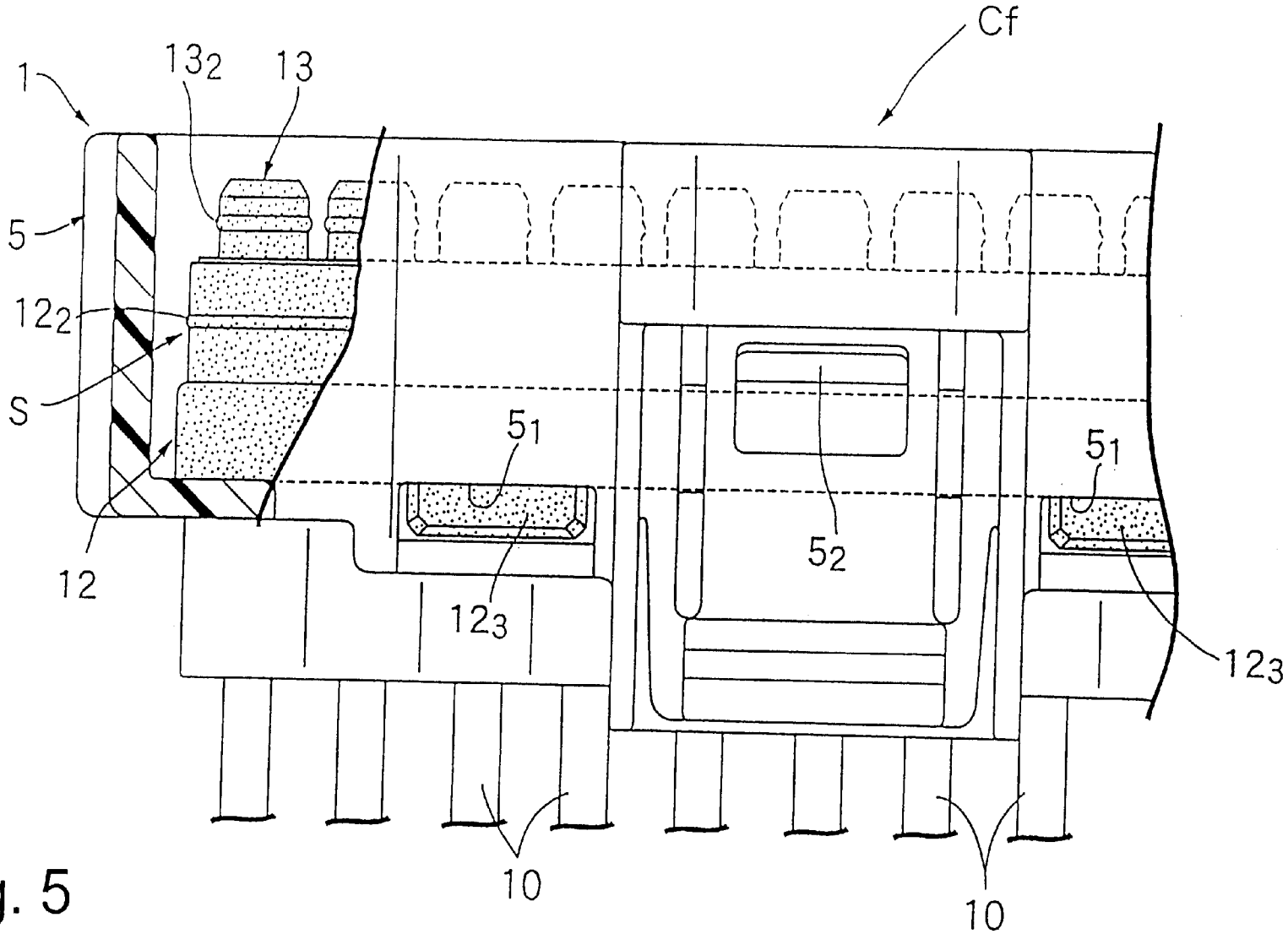
FIG. 5 is a view in the direction of arrow 5 in FIG. 4.

As is apparent from FIGS. 3 and 6, the male connector housing 3 of the male connector Cm includes a housing main body 14 fittable in the inner peripheral surface of the housing main body 5 of the female connector housing 1. A collectively fitting recess 15, in which the collectively fitting projection 7 of the female connector housing 1 is fittable, is formed on the inner peripheral surface side of the housing main body 14. Twenty-two (22) individually fitting recesses 16, in which the individually fitting projections 8 of the female connector housing 1 are fittable, are provided in a bottom surface portion of the collectively fitting recess 15. In a bottom wall 17 of the male connector housing 3 are buried intermediate portions of twenty-two (22) male terminals 4. One end of each of the male terminals 4 projects from the center of an associated one of the individually fitting recesses 16 into the collectively fitting recess 15. The other end of the male terminal 4 extends outwardly from the male connector housing 3 and is bent at a right angle.

When the male connector housing 3 is inserted in the female connector housing 1, a locking claw $\mathbf{14}_1$ provided on the housing main body 14 of the male connector housing 3 is engaged with a locking claw $\mathbf{5}_2$ provided on the housing main body 5 of the female connector housing 1, so that the male connector housing 3 is prevented from slipping from the female connector housing 1. In addition, the inner peripheral surface of the collectively fitting recess 15 of the male connector housing 3 is fitted around the outer peripheral surface of the collectively fitting projection 7 of the female connector housing 1 when the collectively sealing portion 12 of the elastic sealing member S is interposed therebetween. The inner peripheral surface of each of the individually fitting recesses 16 of the male connector housing 3 is fitted around the associated one of the individually fitting projections 8 of the female connector housing 1 when an associated one of the individually sealing portions 13 of the elastic sealing member S is interposed therebetween. Furthermore, the collectively sealing lip $\mathbf{12}_2$ of the collectively sealing portion 12 of the elastic sealing member S is in contact with the inner peripheral surface of the collectively fitting recess 15 of the male connector 3. Each of the individually sealing lips $\mathbf{13}_2$ of the individually sealing portions 13 of the elastic sealing member S is in contact with the inner peripheral surface of the associated one of the individually fitting recesses 16 of the male connector housing 3 (see FIG. 8).

Figure 8:
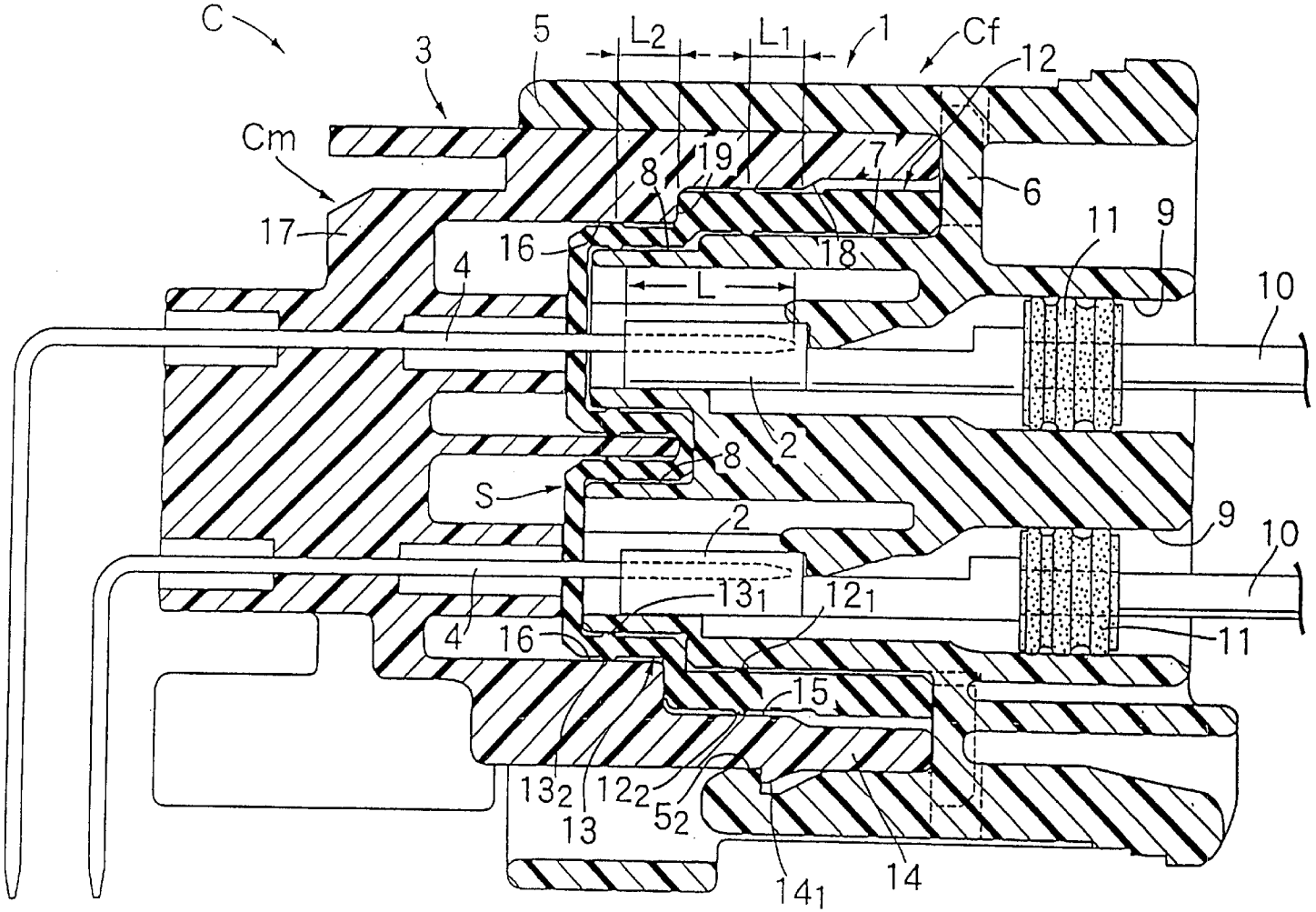
FIG. 8 is a sectional view of the waterproof connector of the present invention in a fill connection state.

As is apparent from FIG. 8, when the male connector Cm is fully connected to the female connector Cf, each of the male terminals 4 is fitted in an associated one of the female terminals 2 by a distance L. Therefore, a distance LI between the collectively sealing lip $\mathbf{12}_2$ formed on the outer peripheral surface of the collectively sealing portion 12 of the elastic sealing member S and a stepped portion 18 formed on the inner peripheral surface of the collectively fitting recess 15 of the male connector housing 3, is set to be smaller than the above fitting distance L. In addition, a distance L2 between the individually sealing lip $\mathbf{13}_2$ formed on the outer peripheral surface of each of the individually sealing portions 13 of the elastic sealing member S and a stepped portion 19 which is formed at the boundary between the collectively fitting recess 15 and the individually fitting recesses 16 of the male connector housing 3 is set to be smaller than the above fitting distance L and to be nearly equal to the value L1.

The function of the first embodiment of the present invention having the above configuration will now be described. When the male connector Cm is fully connected to the female connector Cf with the elastic sealing member S interposed therebetween as shown in FIG. 8, the pair of collectively sealing lips $\mathbf{12}_1$ and $\mathbf{12}_2$ respectively provided on the inner and outer peripheral surfaces of the collectively sealing portion 12 of the elastic sealing member S are respectively brought in contact with the collectively fitting projection 7 of the female connector housing 1 and the collectively fitting recess 15 of the male connector housing 3. This provides a first waterproofed connection area. Also, in the above connection state, the pair of individually sealing lips $\mathbf{13}_1$ and $\mathbf{13}_2$ respectively provided on the inner and outer peripheral surfaces of each of the individually sealing portions 13 of the elastic sealing member S are respectively brought in contact with an associated one of the individually fitting projections 8 of the female connector housing 1 and an associated one of the individually fitting recesses 16 of the male connector housing 3. This provides a second waterproofed connection area.

By waterproofing the mutual contact regions of each of the female terminals 2 and the associated one of the male terminals 4 by the double-stage sealing lips composed of the collectively sealing lips $\mathbf{12}_1$ and $\mathbf{12}_2$ and the individually sealing lips $\mathbf{13}_1$ and $\mathbf{13}_2$ as described above, it is possible to enhance the waterproof effect more than that obtained by single-stage sealing lips. To be more specific, if water permeates through the collectively sealing lips $\mathbf{12}_1$ and $\mathbf{12}_2$ of the collectively sealing portion 12, the flow of water is prevented from reaching the mutual contact regions of each of the female terminals 2 and the associated one of the male terminals 4 because the permeation of water is blocked by the individually sealing lips $\mathbf{13}_1$ and $\mathbf{13}_2$ of the associated one of the individually sealing portions 13. Even if water, which has permeated through the collectively sealing lips $\mathbf{12}_1$ and $\mathbf{12}_2$ of the collectively sealing portion 12, further permeates through the individually sealing lips $\mathbf{13}_1$ and $\mathbf{13}_2$ of any one of the individually sealing portions 13, only the associated female and male terminals 2 and 4 are rendered wet, with the remaining female and male terminals 2 and 4 prevented from conducting with the wet terminals. As a result, it is possible to suppress the occurrence of short-circuits and electrolytic corrosion.

Since the pair of collectively sealing lips $\mathbf{12}_1$ and $\mathbf{12}_2$ are respectively provided on the inner and outer surfaces of the collectively sealing portion 12 at positions identical to each other in the longitudinal direction, they can be compressed to be respectively brought in contact with the collectively fitting projection 7 and the collectively fitting recess 15 at a high surface pressure. This further increases the waterproof effect. If a plurality of rows of the collectively sealing lips $\mathbf{12}_1$ and $\mathbf{12}_2$ and a plurality of rows of the individually sealing lips $\mathbf{13}_1$ and $\mathbf{13}_2$ are arranged in parallel, the total frictional force is increased, which makes difficult the connecting/separating operation of the waterproof connector C. In this regard, according to this embodiment, since only one row of the collectively sealing lips $\mathbf{12}_1$ and $\mathbf{12}_2$ and one row of the individually sealing lips $\mathbf{13}_1$ and $\mathbf{13}_2$ are provided. It is possible to keep the frictional force at a minimum and facilitate the connecting/separating operation of the connector C.

Figure 9:
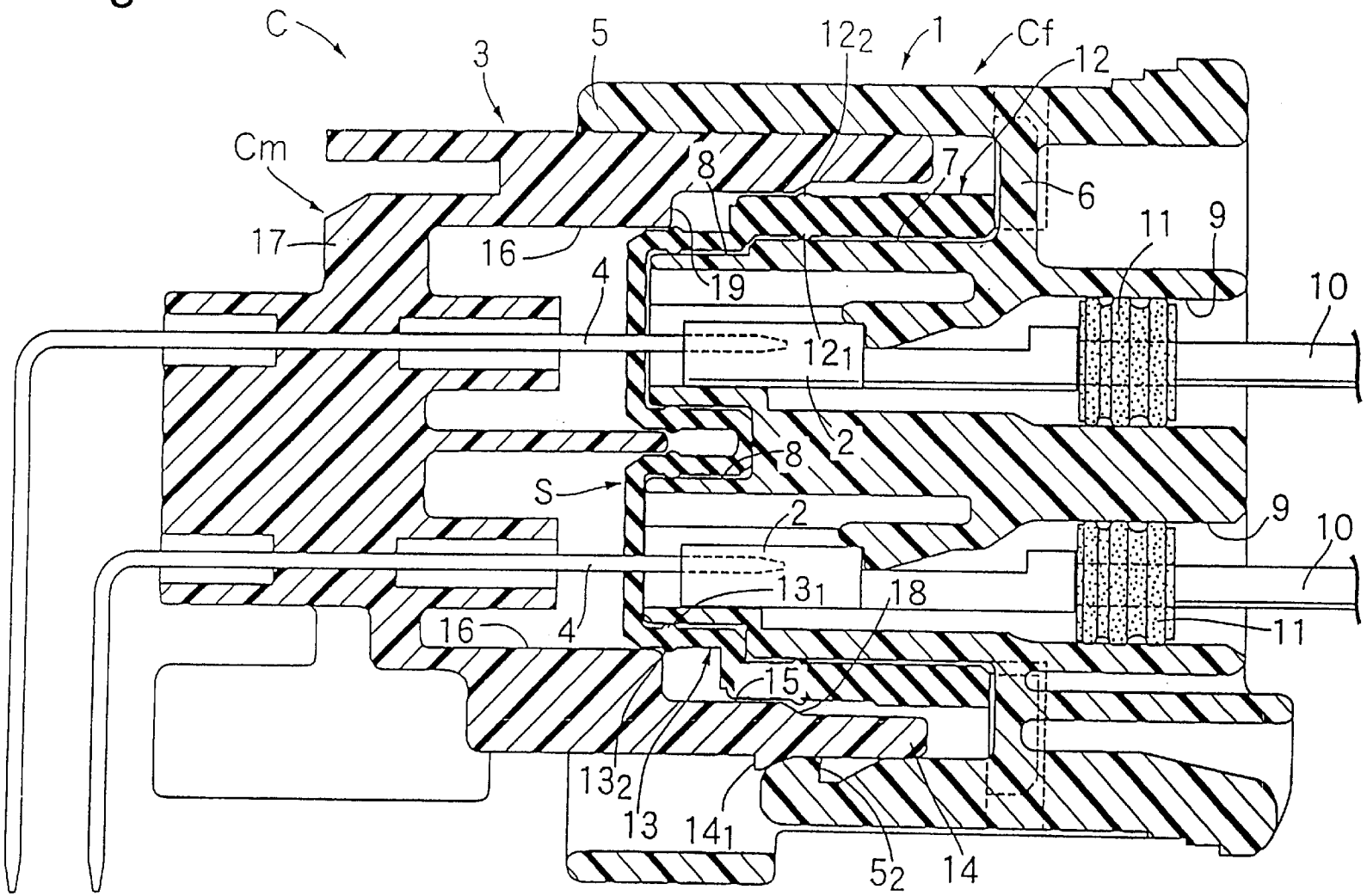
FIG. 9 is a sectional view of the waterproof connector of the present invention in a semi-connection state.

A manner of separating the male connector Cm from the female connector Cf from a fully connected position as illustrated in FIG. 8 will now be described with reference to FIG. 9. Referring to FIG. 9, the male connector Cm is moved relative to the elastic sealing member S fixed on the female connector Cf side. At this time, the inner peripheral sealing surface of the collectively fitting recess 15 of the male connector housing 3 is slid in contact with the collectively sealing lip $\mathbf{12}_2$ of the elastic sealing member S. When the sliding distance reaches a value L1 as shown in FIG. 8, the collectively sealing lip $\mathbf{12}_2$ moves out of contact with the sealing surface of the collectively fitting recess 15. Therefore, the surface pressure of the collectively sealing lip $\mathbf{12}_2$ disappears. Similarly, the inner peripheral sealing surface of each of the individually fitting recesses 16 of the male connector housing 3 is slid in contact with an associated one of the individually sealing lips $\mathbf{13}_2$ of the elastic member S. When the sliding distance reaches the value L2 as shown in FIG. 8, the individually sealing lips $\mathbf{13}_2$ move out of contact with the sealing surface of the individually fitting recesses 16. Therefore, the surface pressure of the collectively sealing lip $\mathbf{13}_2$ disappears.

Since the surface pressure of the collectively sealing lip $\mathbf{12}_2$ and each of the individually sealing lips $\mathbf{13}_2$ disappears only by drawing the male connector housing 3 from the female connector housing 1 for the sliding distance L1 or L2 which is smaller than the sliding distance L for which each of the male terminals 4 is fitted in the associated one of the female terminals 2 as described above, it is possible to reduce the stroke which causes a frictional force produced by the above surface pressure. Therefore, the male connector Cm is easily separated from the female connector Cf. In the case of connecting the male connector Cm to the female connector Cf, similarly, the stroke is reduced, thereby facilitating the connecting operation.

A second embodiment of the present invention will now be described with reference to FIGS. 10 and 11. While the elastic sealing member S of the waterproof connector C in the first embodiment is supported on the female connector Cf side, the elastic sealing member S of the waterproof connector C in the second embodiment is supported on the male connector Cm side. A locking projection 21 provided at the boundary between the collectively sealing portion 12 and the individually sealing portions 13 of the elastic sealing member S is to be engaged in a locking groove 22 recessed at the boundary between the collectively fitting recess 15 and the individually fitting recesses 16 of the male connector housing 3.

Figure 10:
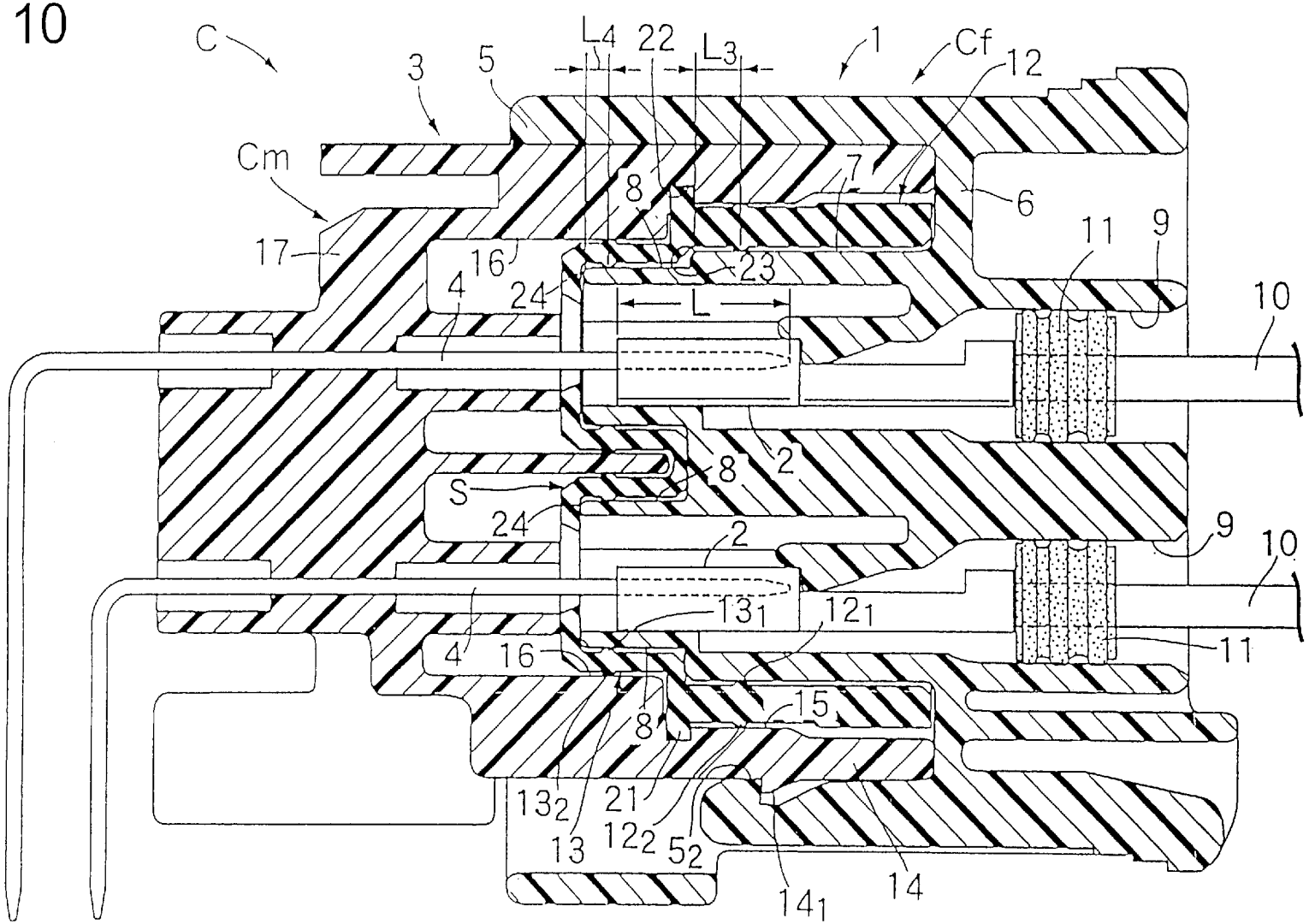
FIG. 10 is a sectional view of a waterproof connector of the present invention in a full connection state, according to a second embodiment of the present invention.
Figure 11:
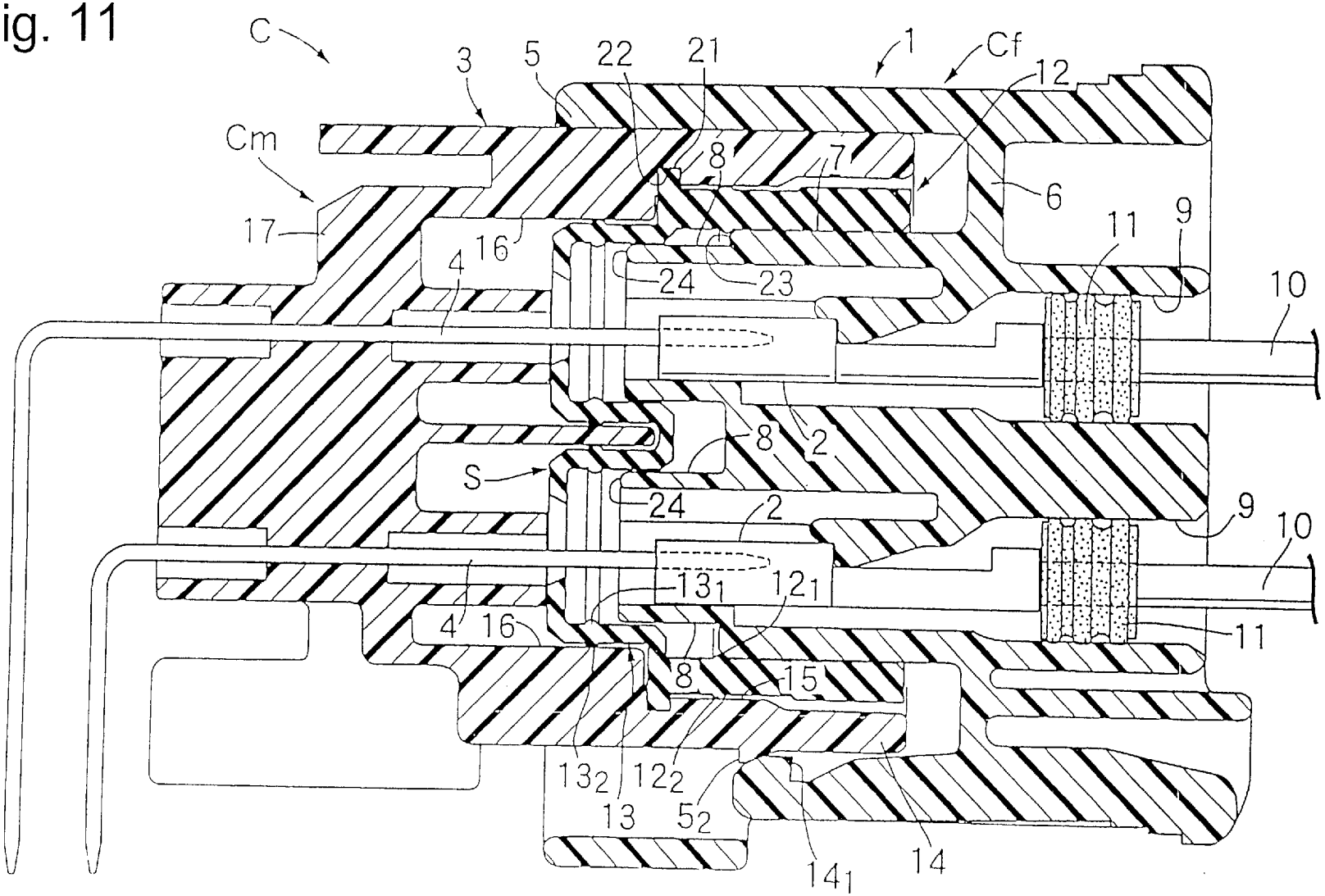
FIG. 11 is a sectional view of the waterproof connector of the present invention in a semi-connection state, according to the second embodiment.

In FIG. 10, when the male connector Cm is fully connected to the female connector Cf via the elastic sealing member S, a distance L3 between the collectively sealing lip $\mathbf{12}_1$ provided on the inner peripheral surface of the collectively sealing portion 12 of the elastic sealing member S and a stepped portion 23 which is formed at the boundary between the collectively fitting projection 7 and the individually fitting projections 8 of the female connector housing 1, is set to be smaller than the fitting distance L for which each of the male terminals 4 is fitted in the associated one of the female terminals 2. Also, a distance L4 between each of the individually sealing lips $\mathbf{13}_1$ provided on the inner peripheral surface of the associated one of the individually sealing portions 13 of the elastic sealing member S and the leading end 24 of the associated one of the individually fitting projections 8 of the female connector housing 1, is set to be smaller than the above distance L3. The other elements of the configuration of the second embodiment are the same as those of the configuration of the above-described first embodiment.

According to the second embodiment, when the female connector Cf is moved relative to the elastic sealing member S fixed on the male connector Cm side in the course of separating the female connector Cf and the male connector Cm from the full connection state, the outer peripheral sealing surface of the collectively fitting projection 7 of the female connector housing 1 is slid in contact with the collectively sealing lip $\mathbf{12}_1$ of the elastic sealing member S. When the sliding distance reaches the value L3, the collectively sealing lip $\mathbf{12}_1$ moves out of contact with the sealing surface of the collectively fitting projection 7. Therefore, the surface pressure of the collectively sealing lip $\mathbf{12}_1$ disappears. At the same time, the outer peripheral sealing surface of each of the individually fitting projections 8 of the female connector housing 1 is slid in contact with an associated one of the individually sealing lips $\mathbf{13}_1$ of the elastic sealing member S. When the sliding distance reaches a value L4 which is smaller than the above value L3, the individually sealing lip $\mathbf{13}_1$ moves out of contact with the sealing surface of the individually fitting projection 8. Therefore, the surface pressure of the collectively sealing lip $\mathbf{13}_1$ disappears.

Since the surface pressure of the collectively sealing lip $\mathbf{12}_1$ and each of the individually sealing lips $\mathbf{13}_1$ disappears only by drawing the female connector housing 1 from the male connector housing 3 for the sliding distance L3 or L4 which is smaller than the sliding distance L for which each of the male terminals 4 is fitted in the associated one of the female terminals 2 as described above, it is possible to reduce the stroke which causes a frictional force produced by the above surface pressure. In the case of connecting the female connector Cf to the male connector Cm, similarly, the stroke can be reduced to a minimum, thereby facilitating the connecting operation.

While the embodiments of the present invention have been described in detail, such description is for only illustrative purposes only, and it is to be understood that many changes in design may be made without departing from the scope of the present invention.

According to the first aspect of the present invention, when the male connector is connected to the female connector, the space between the collectively fitting projection of the female connector housing and the collectively fitting recess of the male connector housing is sealed by the pair of collecting sealing lips provided on the collectively sealing portion of the sealing member. Furthermore, the space between each of the individually fitting projections of the female connector housing and the associated one of the individually fitting recesses of the male connector housing is sealed by the pair of the individually sealing lips provided on the associated one of the individually sealing portions of the sealing member. Accordingly, the mutual contact regions of each of the female terminals and the associated one of the male terminals are sealed in double-stages, resulting in the enhanced waterproofing. Also, with the configuration according to the first aspect of the present invention, the pair of the individually sealing lips are respectively formed on the inner and outer surfaces of the collectively sealing portion of the sealing member at positions identical to each other in the longitudinal direction. Furthermore, the pair of collectively sealing lips are respectively formed on the inner and outer surfaces of each of the individually sealing portions at positions identical to each other in the longitudinal direction. As a result, it is possible to suppress a frictional force produced between the seal lips and the sealing surfaces to a minimum upon connection/separation of the male connector to/from the female connector while ensuring good waterproofing by bringing the seal lips into close-contact with the sealing surfaces. Therefore, the operation of connecting/separating the male connector to/from the female connector is improved.

According to the second and third aspects of the present invention, when the male connector is connected to the female connector, the space between the collectively fitting projection of the female connector housing and the collectively fitting recess of the male connector housing by the pair of collectively sealing lips provided on the collectively sealing portion of the sealing member are sealed.

Furthermore, the space between each of the individually fitting projections of the female connector housing and the associated one of the individually fitting recesses of the male connector housing is sealed by the pair of individually sealing lips provided on the associated one of the individually sealing portions of the sealing member. Accordingly, the mutual contact regions of each of the female terminals and the associated one of the male terminals is sealed in double-stages, resulting in the enhanced waterproofing. Also, since each of the sliding distances for which each of the individually sealing lips and the collectively sealing lip are respectively slid in contact with the associated sealing surfaces is smaller than the fitting distance for which each of the male terminals is fitted in the associated one of the female terminals when the male connector is connected to the female connector, it is possible to reduce the stroke which causes a sliding resistance due to friction of the seal lips. Therefore, the operation of connecting/separating the male connector to/or from the female connector is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waterproof connector comprising:

a female connector including a female connector housing and a plurality of female terminals supported by said female connector housing, said female connector including:

a collectively fitting projection projecting from said female connector housing; and a plurality of individually fitting projections provided on a top surface of said collectively fitting projection, each of said individually fitting projections supporting an associated one of said female terminals;

a male connector including a male connector housing and a plurality of male terminals supported by said male connector housing, said male connector including:

a collectively fitting recess into which said collectively fitting projection of said female connector housing is fittable; and a plurality of individually fitting recesses into each of which an associated one of said individually fitting projections of said female connector housing is fittable, said individually fitting recesses being recessed in a bottom surface portion of said collectively fitting recess, each of said individually fitting recesses supporting an associated one of said male terminals; and an elastic sealing member interposed between said female connector housing and said male connector housing when said male connector is connected to said female connector, to seal mutual contact regions of each of said female terminals and an associated one of said male terminals, said elastic sealing member including:

a collectively sealing portion; and a plurality of individually sealing portions provided integrally with said collectively sealing portion and extending away from said collectively sealing portion.

2. The waterproof connector according to claim 1, wherein the elastic sealing member is a separate element located between the female connector housing and the male connector housing, and said collectively sealing portion and said plurality of individually sealing portions are a single piece.

3. The waterproof connector according to claim 1, wherein said collectively sealing portion seals between said collectively fitting projection and said collectively fitting recess and each of said plurality of individually sealing portions seals between said plurality of individually fitting projections and said plurality of individually fitting recesses, respectively.

4. The waterproof connector according to claim 1, wherein said collectively sealing portion is held between said collectively fitting projection of said female connector housing and said collectively fitting recess of said male connector housing when said male connector is connected to said female connector.

5. The waterproof connector according to claim 4, wherein each of said individually sealing portions is held between an associated one of said plurality of individually fitting projections of said female connector housing and an associated one of said plurality of individually fitting recesses of said male connector housing when said male connector is connected to said female connector.

6. The waterproof connector according to claim 5, further comprising:

a pair of collectively sealing lips formed on inner and outer peripheral surfaces of said collectively sealing portion at positions identical to each other in the longitudinal direction, respectively, said pair of collectively sealing lips are allowed to be brought into contact with said collectively fitting projection and said collectively fitting recess, respectively; and a pair of individually sealing lips formed on inner and outer peripheral surfaces of each of said individually sealing portions at positions identical to each other in the longitudinal direction, respectively, each of said pairs of individually sealing lips is allowed to be brought into contact with an associated one of said individually fitting projections and an associated one of said individually fitting recesses, respectively.

7. The waterproof connector according to claim 1, wherein said collectively sealing portion has a collectively sealing lip, and when said male connector is connected to said female connector, said lip is allowed to be brought into contact with said collectively fitting recess when said collectively sealing portion is held between said collectively fitting projection of said female connector housing and said collectively fitting recess of said male connector housing.

8. The waterproof connector according to claim 7, wherein each of said individually sealing portions has an individually sealing lip, and when said male connector is connected to said female connector, each of said individually sealing lips is allowed to be brought into contact with an associated one of said individually fitting recesses when each of said individually sealing portions is held between an associated one of said plurality of individually fitting projections of said female connector housing and an associated one of said plurality of individually fitting recesses of said male connector housing.

9. The waterproof connector according to claim 8, wherein when said male connector is connected to said female connector, a sliding distance for which said collectively sealing lip is slid in contact with said collectively fitting recess is smaller than a fitting distance for which each of said male terminals is fitted into an associated one of said female terminals, and a sliding distance for which each of said individually sealing lips is slid in contact with an associated one of said individually fitting recesses is also smaller than said fitting distance.

10. The waterproof connector according to claim 1, wherein said collectively sealing portion has a collectively sealing lip, and when said male connector is connected to said female connector, said collectively sealing lip is allowed to be brought into contact with said collectively fitting projection when said collectively sealing portion is held between said collectively fitting projection of said female connector housing and said collectively fitting recess of said male connector housing.

11. The waterproof connector according to claim 10, wherein each of said individually sealing portions has an individually sealing lip, and when said male connector is connected to said female connector, each of said individually sealing lips is allowed to be brought into contact with an associated one of said individually fitting projections when each of said individually sealing portions is held between an associated one of said plurality of individually fitting projections of said female connector housing and an associated one of said plurality of individually fitting recesses of said male connector housing.

12. The waterproof connector according to claim 11, wherein when said male connector is connected to said female connector, a sliding distance for which said collectively sealing lip is slid in contact with said collectively fitting projection is smaller than a fitting distance for which each of said male terminals is fitted into an associated one of said female terminals; and a sliding distance for which each of said individually sealing lips is slid in contact with an associated one of said individually fitting projections is also smaller than said fitting distance.

* * * * *